US007052061B2

(12) United States Patent
Calagui

(10) Patent No.: US 7,052,061 B2
(45) Date of Patent: May 30, 2006

(54) MECHANIZED STICKS HOLDER

(76) Inventor: Juanito B. Calagui, P.O. Box 325, Passaic, NJ (US) 07055

( * ) Notice: Subject to any disclaimer, the term of this patent is extended or adjusted under 35 U.S.C. 154(b) by 92 days.

(21) Appl. No.: 10/811,280

(22) Filed: Mar. 26, 2004

(65) Prior Publication Data

US 2004/0212203 A1 Oct. 28, 2004

(51) Int. Cl.
*B25B 7/00* (2006.01)

(52) U.S. Cl. ..... 294/99.2; 294/1.1

(58) Field of Classification Search ..... 294/16, 294/28, 99.2; A47G 21/10
See application file for complete search history.

(56) References Cited

U.S. PATENT DOCUMENTS 4,659,128 A * 4/1987 Dong ..... 294/99.2
5,192,106 A * 3/1993 Kaufman ..... 294/99.2
5,697,659 A 12/1997 Calagui
5,911,462 A * 6/1999 Hui ..... 294/99.2
6,454,328 B1 9/2002 Barillos
6,547,296 B1 * 4/2003 Perkitny et al. ..... 294/16

FOREIGN PATENT DOCUMENTS

JP 09122187 * 5/1997
JP 09252911 * 9/1997

* cited by examiner

*Primary Examiner*—Eileen D. Lillis
*Assistant Examiner*—Esther Onyinyechi Okezie
(74) *Attorney, Agent, or Firm*—Walter J. Tencza, Jr.

(57) ABSTRACT

An apparatus is disclosed including a first device which includes a first stick having a first tip, a second device which includes a second stick having a second tip, and a third device which includes a first hollow tube in which a spring is located. The first and second devices may be connected to the third device so that the first and second sticks can pivot with respect to the third device. In a rest state, the spring causes the first stick to be separated from the second stick so that the first tip and the second tip do not contact each other. The first stick and the second stick can be pressed together into a compressed state, so that the first and second sticks pivot with respect to the third device, the spring is compressed by the first and second devices, and the first and second tips come into contact with each other.

7 Claims, 5 Drawing Sheets

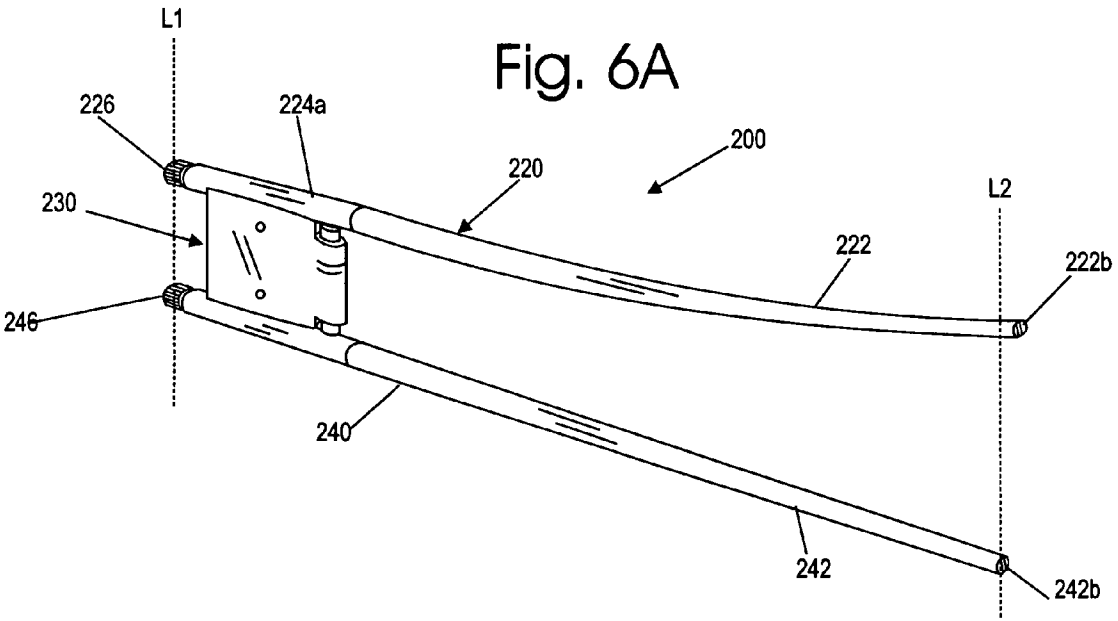
Fig. 6A
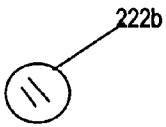
Fig. 6C
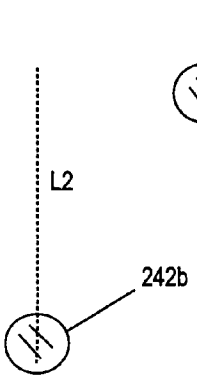
Fig. 6D
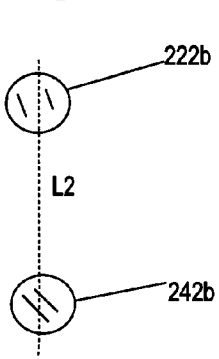
Fig. 6B
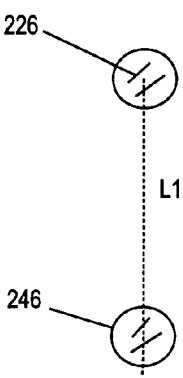

MECHANIZED STICKS HOLDER

FIELD OF THE INVENTION

This invention relates to improved methods and apparatus concerning chopsticks holders.

BACKGROUND OF THE INVENTION

Various devices are known for holding two sticks together in a chopsticks type arrangement. U.S. Pat. No. 6,454,328 to Barillos and U.S. Pat. No. 5,697,659 to Calagui show examples of devices of this type.

SUMMARY OF THE INVENTION

The present invention in one or more embodiment provides an apparatus comprising a first device which includes a first stick having a first tip, a second device which includes a second stick having a second tip, and a third device which includes a first hollow tube in which a spring is located. The first device may be connected to the third device so that the first stick can pivot with respect to the third device. The second device may be connected to the third device so that the second stick can pivot with respect to the third device. In a rest state, the spring causes the first stick to be separated from the second stick so that the first tip and the second tip do not contact each other. The first stick and the second stick can be pressed together into a compressed state, so that the first stick pivots with respect to the third device, the second stick pivots with respect to the third device, the spring is compressed by the first and second devices, and the first tip and the second tip come into contact with each other.

The third device may include a block portion, which is fixed to the first hollow tube. The first device may include a second hollow tube connected to a first extension. The first stick can be inserted into the second hollow tube. The first extension can be inserted into a first slot of the block portion. The second device may include a third hollow tube connected to a second extension. The second stick can be inserted into the third hollow tube. The second extension can be inserted into a second slot of the block portion. The block portion may include a first opening through which a first pin can be inserted to connect the first device to the third device and to allow the first device to pivot with respect to the third device. The block portion may include a second opening through which a second pin can be inserted to connect the second device to the third device and to allow the second device to pivot with respect to the third device.

The first device may include a first fastener. The first stick can be inserted into the second hollow tube and attached to the second hollow tube by the first fastener. The second device may include a second fastener. The second stick can be inserted into the third hollow tube and attached to the third hollow tube by the second fastener.

BRIEF DESCRIPTION OF THE DRAWINGS

FIG. 6A shows a perspective view of an apparatus in accordance with another embodiment of the present invention;

FIG. 6B shows the alignment of two ends of the apparatus of FIG. 6A;

FIG. 6C shows the misalignment of first and second tips of the apparatus of FIG. 6A;

FIG. 6D shows the alignment of first and second tips of the apparatus of FIG. 6A;

DETAILED DESCRIPTION OF THE DRAWINGS

Figure 1:
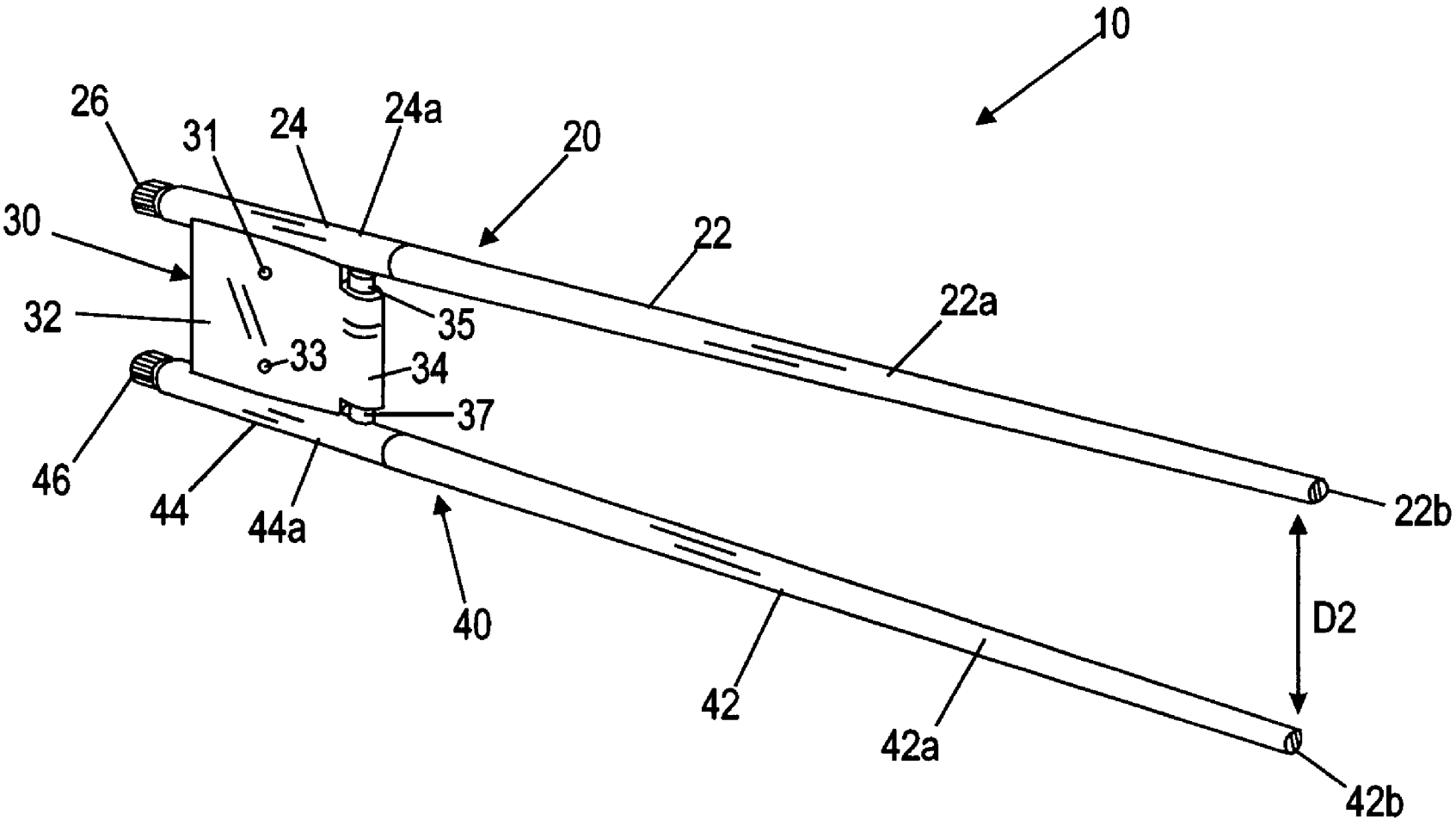
FIG. 1 shows a perspective view of an apparatus in accordance with an embodiment of the present invention.
Figure 2:
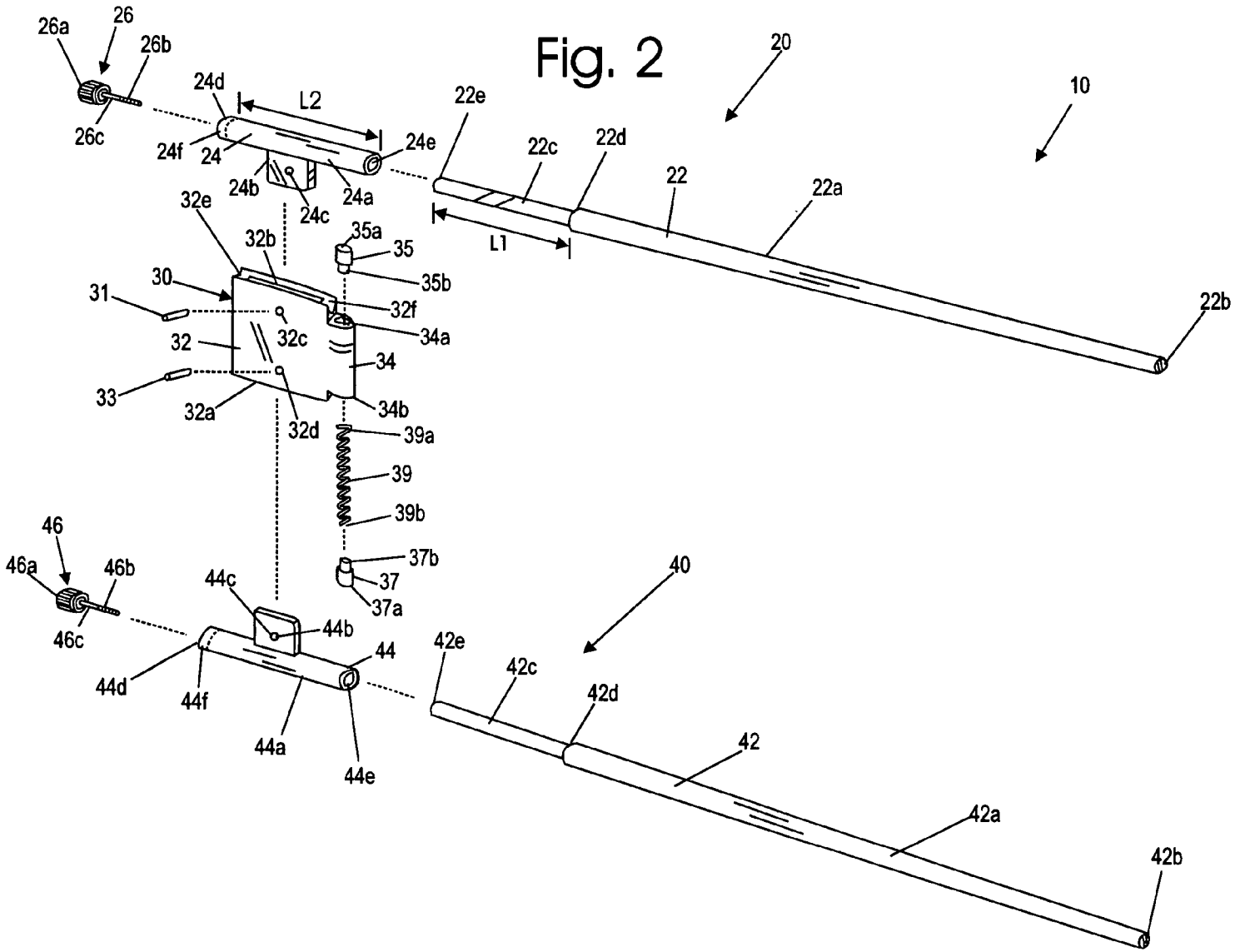
FIG. 2 shows a perspective view of the apparatus of FIG. 1 taken apart.

FIG. 1 shows a perspective view of an apparatus 10 in accordance with an embodiment of the present invention. FIG. 2 shows a perspective view of the apparatus 10 of FIG. 1 taken apart. The apparatus 10 includes devices 20, 30, and 40. Referring to FIG. 2, device 20 includes an elongated member or stick 22, which is comprised of portions 22*a* and 22*c*. The portions 22*a* and 22*c* are joined at end or junction 22*d*. The portion 22*a* may be a solid member or tube, which has a diameter which gradually decreases from a thickest part at junction 22*d* to a thinnest part at a tip or end 22*b*. The portion 22*c* may be a hollow tube having a uniform diameter and having inner threads. The portion 22*c* may have an end 22*e* at which there is an opening.

The device 20 also includes a portion 24. Portion 24 may include a hollow tube 24*a* having openings at ends 24*e* and 24*d*. Portion 24 may also include an extension or protrusion 24*b* which is fixed to the outside of hollow tube 24*a*. The extension 24*b* may include an opening 24*c*. The device 20 also includes a device 26. The device 26 may include a cap or handle portion 26*a* fixed to a screw 26*b*. The screw 26*b* has outer threads.

The device 40 may be identical to the device 20. However, the components of device 40 have been given different numbers for explanation purposes. Device 40 includes an elongated member or stick 42, which is comprised of portions 42*a* and 42*c*. The portions 42*a* and 42*c* are joined at end or junction 42*d*. The portion 42*a* may be a solid member or tapered tube, which has a diameter which gradually decreases from a thickest part at junction 42*d* to a thinnest part at a tip or end 42*b*. The portion 42*c* may be a hollow tube having a uniform diameter and having inner threads. The portion 42*c* may have an end 42*e* at which there is an opening. The device 40 also includes a portion 44. Portion 44 may include a hollow tube 44*a* having openings at ends 44*e* and 44*d*. Portion 44 may also include an extension or protrusion 44*b* which is fixed to the outside of hollow tube 44*a*. The extension 44*b* may include an opening 44*c*. The device 40 also includes a device 46. The device 46 may include a cap or handle portion 46*a* fixed to a screw 46*b*. The screw 46*b* has outer threads.

Figure 3:
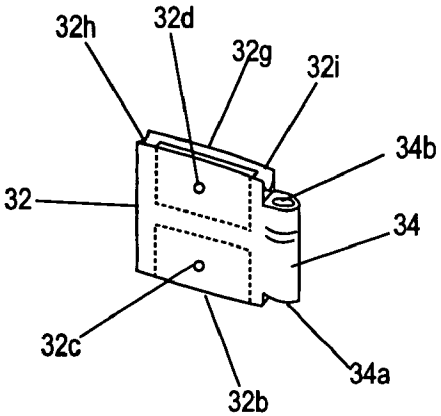
FIG. 3 shows a perspective view of a part of the apparatus of FIG. 1.

Device 30 is shown in the middle of devices 20 and 40. Device 30 includes a block portion 32 fixed to a tube portion 34. The device 30 also includes a pin 31, a pin 33, a member 35, a member 37, and a spring 39. FIG. 2 shows a top perspective view of the device 30. FIG. 3 shows a bottom perspective view of a portion of the device 30. The block portion 32 includes a slot or opening 32*b*, shown in FIG. 2, and a slot or opening 32*g*, shown in FIG. 3. The sizes of the slots or openings 32*b* and 32*g* are shown by dashed lines in FIG. 3. The block portion 32 includes curved or recessed portions 32*e* and 32*f* near slot 32*b*, shown in FIG. 2, and curved or recessed portions 32*h* and 32*i* near slot 32*g*, shown in FIG. 3. The block portion has openings 32*c* and 32*d*. The tube portion 34 is a hollow tube having openings 34*b* and 34*a*.

The apparatus 10 can be assembled from the taken apart depiction shown in FIG. 2 to the depiction shown in FIG. 1, in the following manner. The device 20 can be assembled as follows. The end 22*e* of the member or stick 22 can be inserted into the opening 24*e* of the tube 24*a* of the portion 24. The screw 26*b* can be inserted into the opening 24*d* of the tube 24*a*. The end or opening 24*d* may have internal threads, so that the screw 26*b* can be screwed into the internal threads of end or opening 24*d*. The end or opening 24*d* may also have a stopper, which prevents the end 22*e* of the stick 22 from going all the way through the tube 24*a*. The screw 26*b* can be screwed into the internal threads of the end or opening 22*e* of the portion 22*c*.

The device 40 can be assembled in the same manner as the device 20. The end 42*e* of the member or stick 42 can be inserted into the opening 44*e* of the tube 44*a* of the portion 44. The screw 46*b* can be inserted into the opening 44*d* of the tube 44*a*. The end or opening 44*d* may have internal threads, so that the screw 46*b* can be screwed into the internal threads of end or opening 44*d*. The end or opening 44*d* may also have a stopper, which prevents the end 42*e* of the stick 42 from going all the way through the tube 44*a*. The screw 46*b* can be screwed into the internal threads of the end or opening 42*e* of the portion 42*c*.

The spring 39 is inserted into the tube 34 so that an end 39*a* of the spring 39 lies just outside of or near the opening 34*a* and an end 39*b* of the spring 39 lies just outside of or near the opening 34*b*. A portion 35*b* of the member 35 can be inserted into end 39*a* of the spring 39. A portion 35*a* is thicker than the portion 35*b* and the portion 35*a* will lie outside of the spring 39. A portion 37*b* of the member 37 can be inserted into the end 39*b* of the spring 39. A portion 37*a* is thicker than the portion 37*b* and the portion 37*a* will lie outside of the spring 39.

The extension 24*b* can then be inserted into the slot 32*b*. The opening 24*c* of the extension 24*b* is aligned with the opening 32*c* of the block portion 32. The pin 31 is inserted into the opening 32*c* and into the opening 24*c* thereby joining the extension 24*b* to the block portion 32, and thereby connecting the device 20 to the device 30 in a manner which allows the device 20 to pivot to a limited extent with respect to the device 30.

In a similar manner the extension 44*b* can then be inserted into the slot 32*g*. The opening 44*c* of the extension 44*b* is aligned with the opening 32*d* of the block portion 32. The pin 33 is inserted into the opening 32*d* and into the opening 44*c* thereby joining the extension 44*b* to the block portion 32, and thereby connecting the device 40 to the device 30 in a manner which allows the device 40 to pivot to a limited extent with respect to the device 30.

When the apparatus 10 is assembled, the member 35 presses against the tube 24*a* and the member 37 presses against the tube 44*a*. This keeps the tips 22*b* and 42*b* in a normal state of being apart from one another a certain distance, such as D2, which may be one and a half inches. An individual can flex the members 22*a* and 42*a* towards each other to cause the tips 22*b* and 42*b* to touch each other, or at least to come close enough together to pick up something, such as a piece of food. When the tips 22*b* and 42*b* are forced towards one another, closer than the state of FIG. 1, the tube portion 24*a* pivots about the pin 31 and presses down on the member 35. At the same time the tube portion 44*a* pivots about the pin 33 and presses up on the member 37. The member 35 presses down on the spring 39 while the member 37 presses up on the spring 39 causing the spring 39 to compress. When an individual stops applying pressure to devices 20 and 40, the spring 39 causes the tips 22*b* and 42*b* to return to their normal distance from each other shown in FIG. 1.

Figure 4:
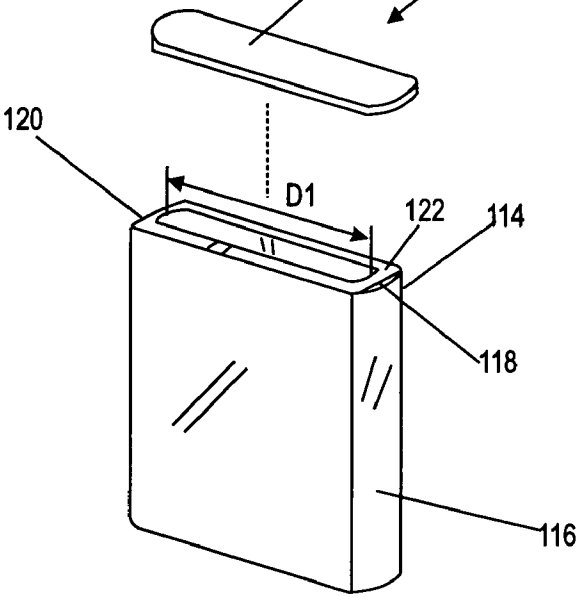
FIG. 4 shows a perspective view of a container for holding portions of the apparatus of FIG. 1.

FIG. 4 shows a perspective view of a container 100 for holding portions of the apparatus 10 of FIG. 1. The container 100 may have a lid 102 and a case 114. The case 114 may have an inner chamber 122 and an outer covering or wall 116. The case 114 may have tapered upper edges 118 and 120. The inner chamber 122 may have a length of Dl, which may be slightly greater than the length of the tube 44*a* and the device 46. The inner chamber 122 may be big enough to fit the device 30, the portions 24 and 44, and the devices 26 and 46.

Figure 5:
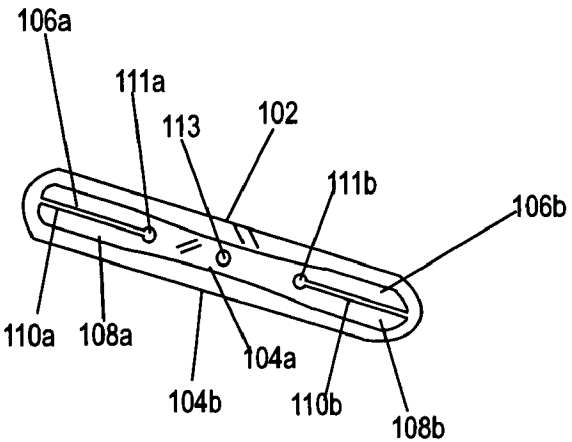
FIG. 5 shows a bottom view of a lid for the container of FIG. 4.

FIG. 5 shows a bottom view of the lid 102 for the container 100 of FIG. 4. The lid 102 includes protrusions 106*a* and 108*a*, which are separated by a gap 110*a* and protrusions 106 and 108*b*, which are separated by a gap 110*b*. The protrusions 106*a–b*, and 108*a–b* lie in a plane with a relief or surface 104*a*, which protrudes out from a surface 104*b* of the lid 102. When pressing the lid 102 to cover the opening to chamber 122 of the case 114 the protrusions 106*a* and 108*a* and the protrusions 106*b* and 108*b* are compressed together closing the gaps 110*a* and 110*b*.

FIG. 6A shows a perspective view of an apparatus 200 in accordance with another embodiment of the present invention. The apparatus 200 is identical with the apparatus 10 of FIG. 1, with the exception that apparatus 200 has a member 222 that curves so that its tip 222*b* does not lie over the tip 242*b*. Sometimes, in the manufacturing process, a member, such as member 222 can become warped. This is a problem because it means that, if the apparatus 200 is left in the state shown in FIG. 6A, and the member 222, is compressed towards the member 242, the tips 222*b* and 242 will not meet. However, in the present invention, the apparatus 200 does not have to be left in the state shown in FIG. 6A. The member 222 can be rotated to place the tip 222*b* over the tip 242*b*. In this case, while the member 222 is rotating, a tube portion 224*a* is kept still in the same position.

FIG. 6B shows the alignment of two ends or devices 226 and 246 of the apparatus 200 of FIG. 6A. The devices 226 and 246 are aligned so that they both lie in a straight-line segment L1. FIG. 6C shows the misalignment of tips 222*b* and 242*b* of the apparatus 200 of FIG. 6A. The tips 222*b* and 242*b* are misaligned so that the tips 222*b* and 242*b* do not lie in a line segment L2, where L2 is parallel to L1. FIG. 6D shows the alignment of tips 222*b* and 242*b*, so that the tips 222*b* and 242*b* both lie in a line segment L2 which is parallel to L1. In this case, the member 222 may be curved downward after rotation, but the tips 222*b* and 242*b* will meet when the members 222 and 242 are compressed towards each other.

Figure 7A:
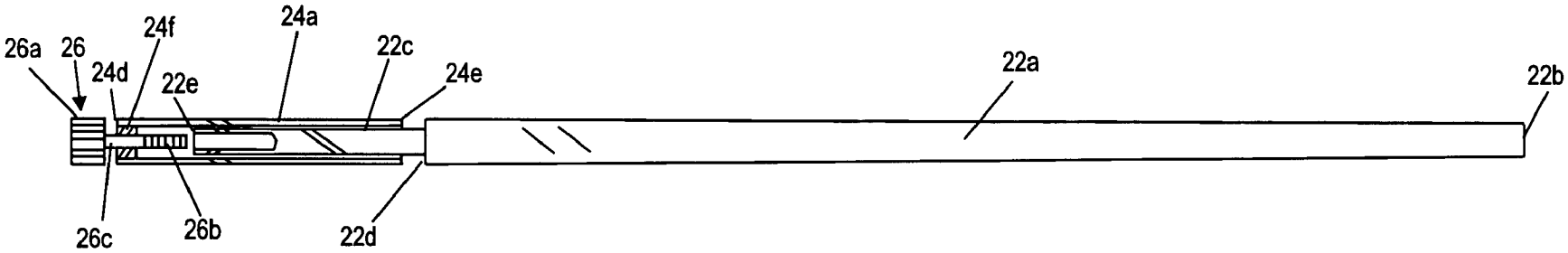
FIG. 7A shows a cross sectional view of part of the apparatus of FIG. 1 in a first state.
Figure 7B:
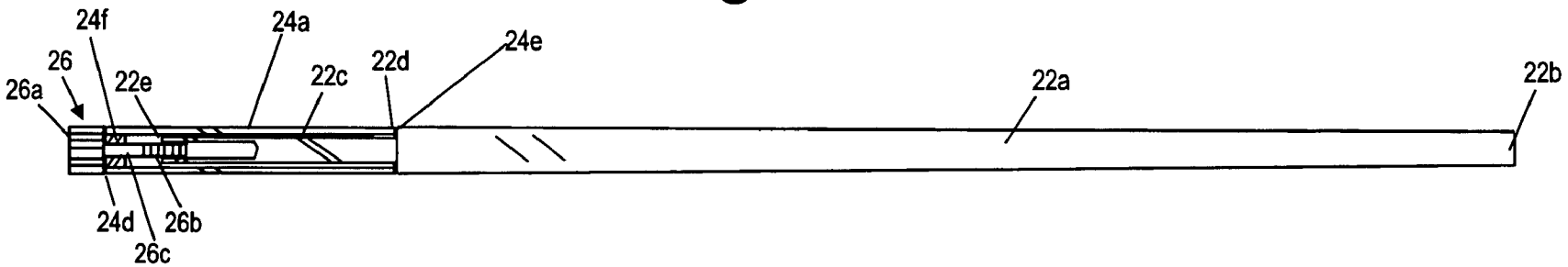
FIG. 7B shows a cross sectional view of part of the apparatus of FIG. 1 in a second state.

FIG. 7A shows a cross sectional view of part of the apparatus 10 of FIG. 1 in a first state. FIG. 7B shows a cross sectional view of part of the apparatus 10 of FIG. 1 in a second state. In the first state shown in FIG. 7A the device 26 is shown with its cap 26*a*, non threaded portion 26*c*, and its threaded portion 26*b*. Also shown in FIG. 7A is the hollow tube 24*a*, the portion 22*c*, and the portion 22*a*. The hollow tube 24*a* includes a portion 24*f* having a diameter smaller than the rest of the hollow tube 24*a*. The threaded portion 26*b* of the device 26 can be screwed into an internally threaded bore of the portion 24*f* until the non threaded portion 26*c* lies in the bore of the portion 24*f*, as in FIG. 7A. In the position or state of FIG. 7A, the device 26 can be slid, without screwing or turning the device 26, to the left until the threaded portion 26*b* contacts the inner threads of the bore of portion 24*f*. The device 26 can also be slid, without screwing or turning the device 26, to the right until the cap 26*a* contacts the end 24*d* of the hollow tube 24*a*. As shown in FIG. 7A, the portion 22*c* is inserted into the larger diameter bore of the tube 24*a*. However, the threaded portion 26*b* of the device or screw 26, is not yet inserted into the portion 22*c*.

In the position or state of FIG. 7B, the threaded portion 26*b* has been screwed a bore of the portion or tube 22*c*. The portion or tube 22*c* may have internal threads. The device 26 can be screwed into the portion 22*c* so that the end 22*d* contacts the end 24*e* of the hollow tube 24*a*, and the cap 26*a* contacts the end 24*d* of the hollow tube 24*a*, as shown in FIG. 7B. However, the end 22*e* typically does not contact the portion 24*f*. This allows the portion or stick 22*a* to be more easily adjusted. Note that L1, shown in FIG. 2, is the length of the portion 22*c* and L2, shown in FIG. 2 is the distance from end or opening 24*e* to portion 24*f*. L1 is typically less than L2 so that the portion 22*c* will not contact the portion 24*f* of the tube 24*a*.

The operation for device 46, tube 44*a*, and portions 42*c* and 42*a* would be identical to the operation described with reference to FIGS. 7A and 7B for device 26, tube 24*a*, and portions 22*c* and 22*a*.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus for holding and using a first chopstick and a second chopstick comprising a first hollow tube connected to a first extension;

a second hollow tube connected to a second extension;

a device having a first slot and a second slot opposite the first slot;

a spring attached to the device and oriented so that in a rest state the spring is substantially perpendicular to the first hollow tube and the second hollow tube;

wherein the first hollow tube and the second hollow tube are biased by the spring, so that in the rest state, the first hollow tube and the second hollow tube are substantially parallel to each other;

wherein the first extension lies at least partially inside of the first slot;

wherein the second extension lies at least partially inside of the second slot;

wherein the first hollow tube and the second hollow tube are spaced apart;

and further comprising a first pin inserted through an opening in the first extension and through a first opening in the device, wherein the first pin thereby connects the first extension to the device so that the first extension and the first hollow tube can pivot to at least some extent with respect to the device using the first pin as a first pivot point;

a second pin inserted through an opening in the second extension and through a second opening in the device, wherein the second pin thereby connects the second extension to the device so that the second extension and the second hollow tube can pivot to at least some extent with respect to the device using the second pin as a second pivot point;

wherein the first pivot point and the second pivot point differ;

wherein the first chopstick can be inserted into the first hollow tube and the second chopstick can be inserted into the second hollow tube so that in the rest state the first chopstick and the second chopstick are substantially parallel to each other.

2. The apparatus of claim 1 wherein the first hollow tube and the second hollow tube are spaced apart by about the length of a dimension of the device.

3. The apparatus of claim 1 further comprising the first chopstick; and the second chopstick.

4. The apparatus of claim 1 wherein the first extension is fixed to an outside surface of the first hollow tube and the first extension projects outward substantially perpendicularly from the outside surface of the first hollow tube; and the second extension is fixed to an outside surface of the second hollow tube and the second extension projects outward substantially perpendicularly from the outside surface of the second hollow tube.

5. The apparatus of claim 1 wherein the spring lies within a third hollow tube, wherein the spring is distinct from the third hollow tube;

wherein in the rest state, the third hollow tube is substantially perpendicular to the first hollow tube and the second hollow tube;

and wherein the third hollow tube is fixed to the device.

6. The apparatus of claim 1 wherein the device is a block structure which in the rest state is substantially perpendicular to the first hollow tube and the second hollow tube.

7. The apparatus of claim 6 wherein the block structure has a first curved surface, which is adjacent the first hollow tube and which limits the extent to which the first hollow tube can pivot which respect to the device; and the block structure has a second curved surface opposite the first curved surface, wherein the second curved surface is adjacent to the second hollow tube, and the second curved surface limits the extent to which the second hollow tube can pivot with respect to the device.

* * * * *